United States Patent [19]

Matsui

[11] Patent Number: 4,655,116

[45] Date of Patent: Apr. 7, 1987

[54] FINE TUNING MECHANISM FOR GUITARS AND THE LIKE STRINGED INSTRUMENTS

[75] Inventor: Kazuhiro Matsui, Aichi, Japan

[73] Assignee: Hoshino Gakki Co., Ltd., Japan

[21] Appl. No.: 729,671

[22] Filed: May 2, 1985

[30] Foreign Application Priority Data

May 9, 1984 [JP] Japan ..... 59-67593[U]

[51] Int. Cl.[4] ..... G10D 3/04; G10D 3/14

[52] U.S. Cl. ..... 84/312 R; 84/297 R; 84/298

[58] Field of Search ..... 84/297 R, 298, 299, 84/312 R, 313

[56] References Cited

U.S. PATENT DOCUMENTS

| | | | |
|---|---|---|---|
| 2,741,146 | 8/1954 | Fender | 84/313 |
| 2,972,923 | 2/1961 | Fender | 84/313 |
| 4,171,661 | 10/1979 | Rose | 84/313 |
| 4,430,919 | 2/1984 | Matsui | 84/299 |
| 4,457,201 | 7/1984 | Storey | 84/313 |
| 4,497,236 | 2/1985 | Rose | 84/298 |
| 4,506,585 | 3/1985 | Desmond | 84/298 |

*Primary Examiner*—Benjamin R. Fuller

*Attorney, Agent, or Firm*—Ostrolenk, Faber, Gerb & Soffen

[57] ABSTRACT

A tuning mechanism for harmonically tuning and pitch tuning guitar strings. The mechanism is part of the bridge. It includes a base and a plurality of saddles which are mounted on the base and are slidable longitudinally back and forth to adjust the effective length of the strings of the guitar. Each saddle is mechanically connected to a guide member which is located in a groove in the base. A tuning screw through the guide member slides the guide member and the saddle back and forth to tune a guitar string. A securing bolt is then tightened to fix the saddle in place on the base. The mechanism also includes a pivotable pitch tuning member which pivots back and forth in response to a pivoting force applied by a pitch tuning screw to adjust string tension. The string receiving end of each saddle can be raised or lowered to adjust the height of the string above the base.

22 Claims, 5 Drawing Figures

FINE TUNING MECHANISM FOR GUITARS AND THE LIKE STRINGED INSTRUMENTS

BACKGROUND OF THE INVENTION

The present invention relates to a fine tuning mechanism for a guitar or other stringed instruments, and more particularly to a harmonic and pitch tuning mechanism which is located at the bridge of a guitar.

Musical strings are both harmonically tuned and pitch tuned. As is known to those skilled in the art, a string is harmonically tuned by adjusting its effective length. It is pitch tuned by adjusting its tension.

It is convenient to describe the present invention in relation to a guitar, although the invention is applicable to other stringed instruments. The main components of a guitar are the body, the peg head, and the elongated neck which extends between the body and the head. The strings extend, essentially in parallel spaced relation to one another, between a bridge located on the body and the head of the guitar. It is also common to anchor or clamp one end of a string on the body, usually at the bridge. The other end of the string is received on a respective tuning peg, located on the head, which pulls the string to adjust its tension. The tuning pegs are the primary means for pitch tuning.

The effective string length, which figures in harmonic tuning, is the length of the intermediate section of the string which extends uninterruptedly between the two connection points on the guitar.

In many guitars, these connection points include a nut element located on the neck near the head and a second point located on the bridge of the guitar. To harmonically tune the guitar, these points are moved closer or farther apart as required.

The present invention provides a tuning mechanism for fine tuning a string by changing string length and/or string tension. The mechanism is located at the bridge of the guitar. Furthermore, it is very accessible, easy to use and can be implemented economically.

A fine tuning mechanism is described in U.S. Pat. No. 4,497,236 to Rose. Rose discloses a series of fine tuning elements arranged on a base. Each fine tuning element includes a forward block element and a rear block element. The rear block element is pivotally secured to the forward block element and pivots about an axis which is parallel to the base. As the rear block element is pivoted, the tension of a guitar string which is attached to the rear block element changes. In addition, the position of the blocks on the base can be moved forward and backward within a limited range to provide harmonic tuning capability.

In another known mechanism, each fine tuning element is a saddle which is movable back and forth on the base of the bridge to tension or relax the string which is attached to one end of the saddle. The other end of the bridge saddle is connected to the threaded shank of an adjusting screw. The head of the screw is connected to a peripheral edge of the base. The string, bridge saddle and adjusting screw extend essentially in line so that by rotating the screw, the bridge saddle is pulled or pushed thereby. To make the bridge saddle vertically flexible, the bridge saddle is not directly clamped or secured to the base. Because the sole connection to the base is through the adjusting screw, the head of the screw becomes a fulcrum point about which the saddle can vibrate. Although vertical flexibility provides certain advantages, the vibration of prior art structures during play reduces the overall accuracy and fidelity of the sounds that are produced.

SUMMARY OF THE INVENTION

Accordingly, it is an object of the present invention to provide a bridge based, instrument string tuning mechanism which overcomes the shortcomings of conventional fine tuning mechanism.

It is another object of the invention to provide a tuning mechanism for harmonic tuning and pitch tuning of stringed muscial instruments.

It is still another object of the invention to provide a harmonic tuning mechanism which integrates and combines the harmonic tuning adjusting screw with the bridge saddle to stabilize the saddle and firmly secure it to the base.

The invention includes a bridge base having several spaced, longitudinally extending, parallel grooves or cutouts therein. The base is mounted atop the guitar body and is so shaped and secured to the guitar that an accessible clearance space is left below the grooves. On the base are mounted a plurality of saddles. Each saddle is connected to one string and is adapted to slide along one respective groove. By changing the position of a saddle, the effective length of the respective string is altered, harmonically tuning the string.

Each bridge saddle is coupled by a guide member to a respective harmonic tuning screw which is located beneath its respective groove. The guide member passes vertically through the groove, and its opposite ends are coupled respectively to the tuning screw and to the bridge saddle. At least one end of the screw is anchored in the base, permitting the screw to rotate but not to move relative to the base. The guide member includes a horizontally extending through-going threaded hole in which the likewise threaded shank of the harmonic tuning screw passes. Because one end of the tuning screw rests against the base, as the screw is rotated, it pulls the guide member and the attached bridge saddle along the groove.

The guide member comprises a lower body section which is located below the groove and is wider than the groove in the base and a top section which passes through the groove. The top section is approximately the width of the groove. The guide member includes steps beneath the base, where the guide member narrows, and these steps contact the underside of the base and are clamped to it as described below, between the guide member and the bridge base.

The top of the guide member includes a vertically oriented, threaded hole which extends across perpendicularly to and preferably intersects the horizontal through-going hole. A securing bolt passes through the saddle and into the vertical hole. In this manner, the bridge saddle is coupled to the guide member.

The saddle is continuously pulled in one direction by the guitary string. The position of the saddle is adjusted by the tuning screw to change the effective length of an to harmonically tune the string.

When harmonic tuning of a given string is completed, the securing bolt is tightened. The steps on the guide member located below the base and the bridge saddle located above it are drawn together to clamp the guide member to the base, thereby directly securing one end of the bridge saddle to the base.

At a string receiving end of the bridge saddle, a pitch tuning member is supported. The pitch tuning member is pivotably attached to the saddle and the string is attached to it, so that pivoting of the tuning member adjusts string tension. The pivotable tuning member extends downwardly from the bridge saddle through a suitable opening in the base. the end of the string is secured to one arm of the tuning member. A pitch tuning screw bears against another arm of the tuning member for pivoting it to change string tension.

The string receiving end of the bridge saddle includes elevation means for raising or lowering the heights of each string with respect to the base. In a preferred embodiment, the elevation means are a pair of vertically oriented screws which are threaded through the bridge saddle and which rest on the base. As the screws are turned, the string receiving end of the bridge saddle is raised or lowered with respect to the the base. Thus, individual pitch and harmonic tuning, as well as height control, are provided for each string.

According to a further preferred embodiment, a tremolo can be connected to the bridge base in the conventional manner. Thus, by pulling the tremolo, the bridge base pivots forwardly to relax the tension on all the strings.

Other features and advantages of the invention will be apparent from the following description of a preferred embodiment of the invention considered with reference to the accompanying drawings.

DESCRIPTION OF THE PREFERRED EMBODIMENT

Figure 1:
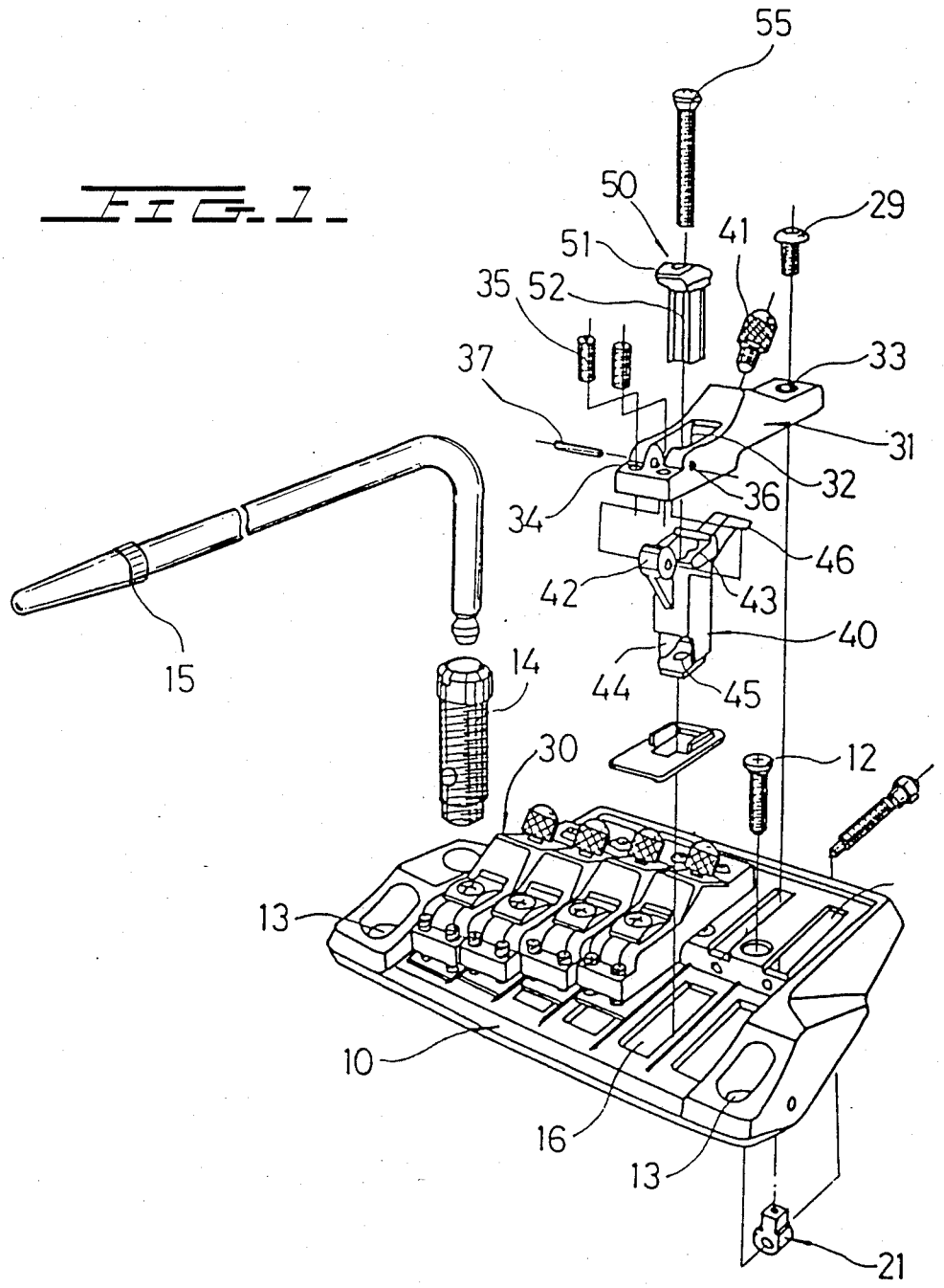
FIG. 1 is a perspective view showing a bridge base with several bridge saddles mounted thereon. One bridge saddle is shown disassembled.

FIG. 1 shows the fine tuning mechanism of the present invention. The mechanism includes bridge base 10 which is mounted on a guitar (not shown) by means of retaining screws which fit through base to body screw holes 13. The bridge base contains two rows of grooves, the forward row 16 and the rearward row 17. Each pair of grooves, 16 and 17, is provided for one string, above each groove pair located on bridge saddle 30.

To the saddle 30 is attached a pitch tuning, string tension adjusting mechanism. The mechanism includes a tuning member 40 which passes through the groove 16 in the base 10. The tuning member 40 includes a pivot bearing 42 supported on the saddle for pivoting. The member 40 includes a generally horizontally extending operating arm 46 and a downward tubular extension with a cutout section 44 for holding the guitar string, as described below. The bottom of the extension is provided with a threaded screw receiving hole 45.

The tuning member 40 is supported in a front cutout 32 defined in the body 31 of the bridge saddle 30. The bearing 42 of the tuning member 40 has an axial hole which is aligned with axial holes 36 in the body 31. The bearing 42 is fixed in position to the body 31 by means of an axial pin 37 which penetrates the axial holes and the bearing and enables the tuning member to pivot. The tuning member 40 is pivotable in one direction (counterclockwise) by the pull of the attached guitar string and in the other direction (clockwise) by pressing down upon its arm 46. A pitch fine tuning screw 41 is screwed into the main body 31 from above to engage the arm 46 for controlling the pivoting of the tuning member 40.

An end of a guitar string 60 (shown in FIG. 2) is strung over the bearing 42 and is hooked in the cutout portion 44 of the tuning member 40. To clamp the string 60 in place, a string securing member 50 is inserted into the cutout 32 in the body 31. The fixed jaw 51 of the string securing member 50 bears against the string 60 and presses it to the tuning member in the vicinity of the bearing 42. A string retaining screw 55 passes through the string securing member 50 and is threadedly received in the threaded hole 45 located in the tuning member 40. Tightening the screw 55 presses down the jaw 51, and the string is firmly held in place. The section of the string between the bearing 42 and the cutout 44 passes through a groove 52 in the string fixing member 50. The accommodating portion 43 of the tuning member 40 is generally shaped to accommodate the string securing member 50 thereon.

Further assembly of the bridge saddle 30 is completed by inserting the threaded height adjustment screws 35 into the corresponding threaded holes 34 located in the body 31 of the bridge saddle 30.

The bridge saddle 30 thus assembled is lowered onto the panel to the bridge base 10, the tuning member penetrating through the groove 16 and extending below it. The saddle 30 is connected to the base 10 by means of the securing screw 29 which passes through an opening 33 and which engages the guide member 21, beneath the base 10 in FIG. 1. The harmonic tuning screw 20 passes through the guide member 21 and is adapted to move the guide member 21 back and forth along the groove 17 as the screw 20 is rotated.

A tremolo arm 15 is associated with a tremolo installation screw 14. In assembled form, the screw 14 is secured to the base 10 and it is engaged by tremolo arm 15. During use, the arm 15 can be pulled to pivot the base 10 forwardly, thereby to relax and lower the tension on all of the strings.

Figure 2:
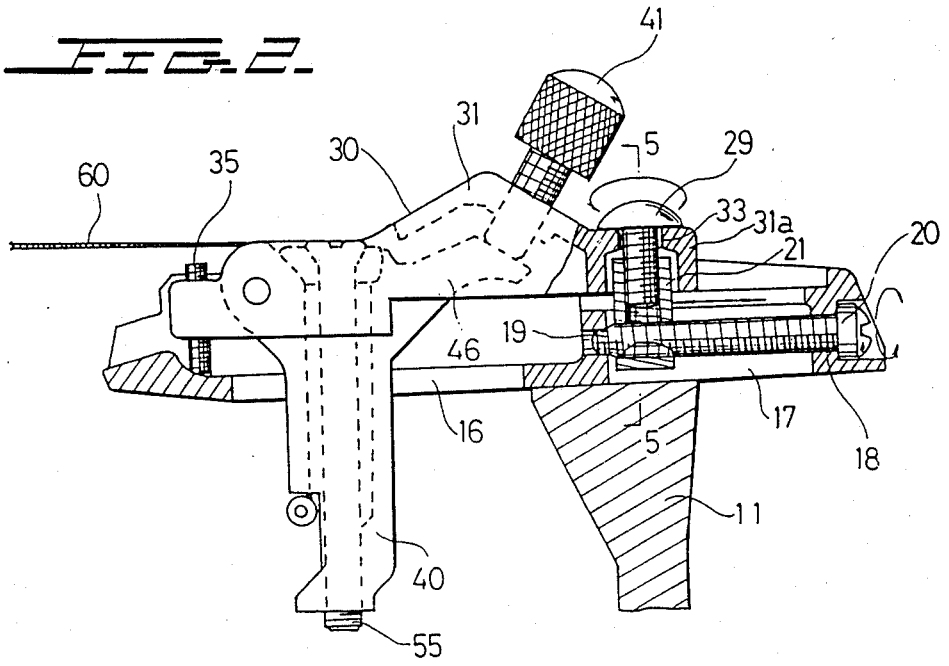
FIG. 2 is an elevational, partially cross-sectional view through a single bridge saddle in accordance with the present invention.

The hanging part 11 in FIG. 2 and the hanging part retaining screw 12 illustrated in FIG. 1 are instrumental for connecting the base 10 to the body of the guitar.

Figure 3:
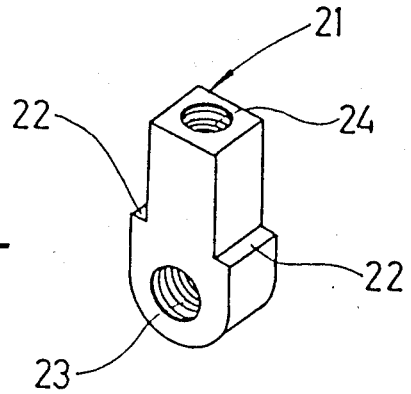
FIG. 3 shows, in perspective, a preferred embodiment of the guide member of the present invention.

Referring to FIGS. 2–5, the interconnection between the bridge saddle 30 and the base 10 is explained. In FIG. 3, the guide member 21 includes a lower section that is somewhat wider than its upper section. This defines a pair of opposite steps 22 for engaging the underside of the base 10, as described below.

Figure 4:
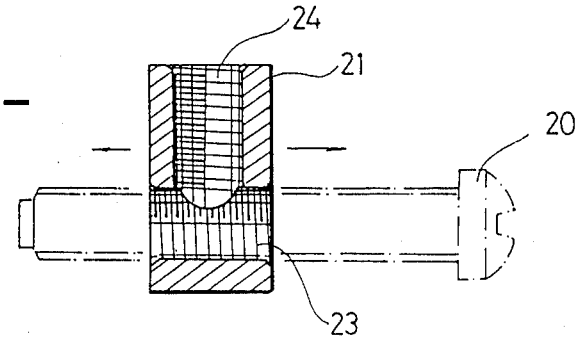
FIG. 4 shows the guide member of FIG. 3 and its associated harmonic tuning screw.

The guide member includes a threaded hole 23 along the length dimension of the guitar. The hole 23 as shown in FIGS. 2 and 4, accommodates the haronic tuning screw 20. The narrowed tip of the screw 20 is received in an opening 19 which is defined in the base 10. the head for turning the screw 20 is accommodated in an opening 18 in the base 10. Because the screw 20 is rotatable only, its rotation moves the guide member 21 (as shown in FIGS. 2 and 4) forwardly and rearwardly along the arrows in the direction of the groove 17.

A vertically oriented securing screw receiving hole 24 is also formed in the guide member for receiving a screw that secures the saddle to the base. The hole 24 extends perpendicularly to and intersects the through hole 23.

Figure 5:
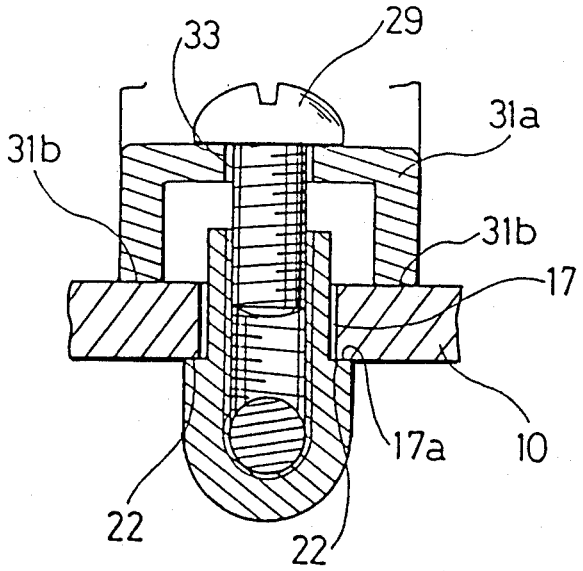
FIG. 5 is a view of FIG. 2 along the lines 5—5.

As shown in FIG. 5, the rear section of the main body 31 of the bridge saddle 30 has an inverted U-shape. The bottom free ends 31*b* of the legs of the U rest upon the base 10. The upper portion 31*a* of the U supports the securing screw 29 in a receiving hole 33. The securing screw 29 passes through the hole 33 and is received in the securing screw receiving hole 24 in the guide member 21. As the screw 29 is tightened, the guide member 21 and the main body 31 of the bridge saddle 30 are drawn to each other so that the steps 22 on the guide member and the leg bottoms 31*b* on the bride saddle are firmly pressed to the base 10. This locks the bridge saddle at a selected harmonic tuning position.

The operation of the fine tuning mechanism in accordance with the present invention is now described with reference to FIG. 2. To harmonically fine tune a given string 60, the securing screw 29 is loosened and the bridge saddle 30 is moved back and forth by rotating the harmonic tuning screw 20 until the string is tuned, and then the securing screw 29 is retightened to secure the bridge saddle 30 to the base 10. String length has been changed.

To pitch tune the string, the pitch fine tuning screw 41 is rotated. Tightening screw 41 pivots the arm 46 which pivots the member 40 clockwise in FIG. 2 for increasing string tension. Loosening of screw 41 permits the tension in the string 60 to pull the member 40 counter-clockwise for reducing string tension. The effective string length of the string 60 is not altered by operation of the screw 41.

The height adjusting screws 35, also shown in FIG. 2, bear against the base 10 and are used for raising or lowering the height of the string receiving end of the bridge saddle 30 above it.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A tuning mechanism for tuning strings of a musical instrument, the mechanism comprising:

a base and means for securing the base to the body of an instrument;

a plurality of saddles mounted to the base next to one another, each saddle being associated with a particular string of the musical instrument; each saddle including means for securing one end of its string to the saddle, the saddle being movable back and forth on the base along a path to vary the effective length of the particular string secured thereto;

a moving means individual to each saddle operable to move the saddle along the path and for holding the saddle on the path even if the saddle is not at the moment secured; and a securing means individual to each saddle and operable for clamping the saddle to the base and for preventing movement of the saddle along the path.

2. The mechanism of claim 1 in which the moving means comprises a harmonic tuning screw which is supported in the base and which is coupled to the saddle such that rotation of the tuning screw moves the saddle along the path.

3. The mechanism of claim 1 in which the securing means comprises a securing bolt which passes through the saddle to the base for clamping the saddle to the base.

4. The mechanism of claim 3, in which the securing bolt passes through an end of the saddle which is located opposite to the string receiving end of the saddle.

5. The mechanism of claim 2 in which the securing means comprises a securing bolt which passes through the saddle to the base for clamping the saddle to the base.

6. The mechanism of claim 5, in which the securing bolt passes through an end of the saddle which is located opposite to the string receiving end of the saddle.

7. The mechanism of claim 5, further comprising a respective guide member for and attached to each saddle, the guide member being located at least partially below the base extending through and movable along a groove defined along the path of the saddle, the securing bolt being engageable with the guide member and having a sufficient tightening range to clamp the saddle to the base, the harmonic tuning screw passing through and threadedly engaging the guide member whereby rotation of the tuning screw causes the guide member to move along the groove.

8. The mechanism of claim 2, further comprising a respective guide member for and attached to each saddle, the guide member being located at least partially below the base extending through and movable along a groove defined along the path of the saddle, the securing means being engageable with the guide member and the base to clamp the saddle to the base, the harmonic tuning screw passing through and threadedly engaging the guide member whereby rotation of the tuning screw causes the guide member to move along the groove.

9. The mechanism of claim 8 in which the guide member comprises a bottom section located below the base and at least one step defined in the bottom for engaging the underside of the base for firmly pressing against the base when the securing bolt is tightened.

10. The mechanism of claim 9 in which the guide member includes a top section located above the bottom and a screw receiving hole in the top, the securing bolt being receivable in the top of the guide member.

11. The mechanism of claim 9 in which the harmonic tuning screw extends coextensively with the groove in the base, the harmonic tuning screw passing through, and threadably engaging, a threaded through-hole which is defined in the bottom section of the guide member.

12. The mechanism of claim 10 in which the dimension of the top of the guide member in the direction of the width of the groove is nearly equal to the width of the groove to thereby provide a close fit between the guide member and the base and to prevent the saddle from moving laterally to the groove.

13. The mechanism of claim 1 further including a respective pitch tuning means for each string and to a respective one of the saddles and comprising:

a rotatable bearing having a string contacting surface which is pivotably mounted to the saddle;

means for firmly securing the respective string to the bearing; and means for rotating the rotatable bearing to alter the tension on its respective string.

14. The mechanism of claim 13 in which each pitch tuning means further comprises a string support member, an actuating arm which extends from the bearing, and the means for rotating comprises a means on the saddle which bears against the actuating arm for pivoting it to rotate the string contacting surface of the bearing to tension the string to a desired degree.

15. The mechanism of claim 14 in which the string support member comprises a tubular member for receiving the end of the string which passes over the bearing and to anchor the string end in the tubular member.

16. The mechanism of claim 15 in which the means for securing the string to the bearing includes a string securing member which comprises an elongated peg which is supported in the tubular member, the peg having a laterally protruding jaw which presses against the bearing and a central screw receiving opening therethrough, and a compressive screw which extends through the peg and which is threadedly received in the tubular member ina manner such that by tightening the compressive screw, the jaw of the peg is pressed with great force against the string contacting surface of the bearing.

17. The mechanism of claim 1, in which the saddle has a string receiving end, a plurality of elevating means, each elevating means being associated with one respective saddle and coupled to its string receiving end, the elevating means including adjusting means which are operable for raising or lowering the string receiving end of its respective saddle with respect to the base.

18. The mechanism of claim 17 in which the elevating means adjusting means comprise at least one screw which passes through and is threadedly supported in the string receiving end of the saddle, the screw extending generally perpendicularly through the saddle and having an end portion which rests on the base, whereby rotating the screw the end of the saddle is either elevated and lowered.

19. The mechanism of claim 1 in which the means for securing the base to the body includes means for permitting the base to tilt toward the head of the musical instrument.

20. The mechanism of claim 17, further comprising a tremolo arm connected to the base and operable to tilt the base.

21. The mechanism of claim 13 in which the means for securing the base to the body includes means for permitting the base to tilt toward the head of the musical instrument.

22. The mechanism of claim 20, further comprising a tremolo arm connected to the base and operable to tilt the base to produce the vibrato effect.

* * * * *